US009980345B2

(12) United States Patent
Chen et al.

(10) Patent No.: US 9,980,345 B2
(45) Date of Patent: May 22, 2018

(54) FLASHING LAMP CONTROL CIRCUIT

(71) Applicant: Shenzhen City Pixel Enterprise Limited, Shenzhen (CN)

(72) Inventors: Wei-Kun Chen, Shenzhen (CN); Jie Zhong, Shenzhen (CN)

(73) Assignee: Shenzhen City Pixel Enterprise Limited, Shenzhen (CN)

( * ) Notice: Subject to any disclaimer, the term of this patent is extended or adjusted under 35 U.S.C. 154(b) by 0 days. days.

(21) Appl. No.: 15/469,585

(22) Filed: Mar. 27, 2017

(65) Prior Publication Data

US 2017/0202073 A1 Jul. 13, 2017

Related U.S. Application Data

(63) Continuation of application No. PCT/CN2014/092409, filed on Nov. 28, 2014.

(51) Int. Cl.
*H05B 37/02* (2006.01)
*H05B 41/30* (2006.01)

(52) U.S. Cl.
CPC ..... *H05B 37/0209* (2013.01)

(58) Field of Classification Search
CPC ..... H05B 37/0209; H05B 37/02; H05B 41/30
USPC ..... 315/307
See application file for complete search history.

(56) References Cited

U.S. PATENT DOCUMENTS 4,654,562 A * 3/1987 Berdat ..... H05B 41/30 315/200 A
5,140,226 A * 8/1992 Lepper ..... H05B 41/34 315/200 A

FOREIGN PATENT DOCUMENTS

CN 104020629 A 9/2014
CN 204206572 U 3/2015

* cited by examiner

*Primary Examiner* — Daniel D Chang
(74) *Attorney, Agent, or Firm* — ScienBiziP, P.C.

(57) ABSTRACT

A control circuit for a flashing lamp provides power for the flashing lamp. The control circuit includes a control module, a strobe module, and a booster module. The control module includes an oscillator and first and second NOR gates. A square wave from the oscillator of the control module controls the first and second NOR gates to output a first control signal and a second control signal of opposite potential to the strobe module. The strobe module controls the booster module to apply boosting to the flashing lamp, reducing the number of components necessary in a control circuit for a flashing lamp.

11 Claims, 1 Drawing Sheet

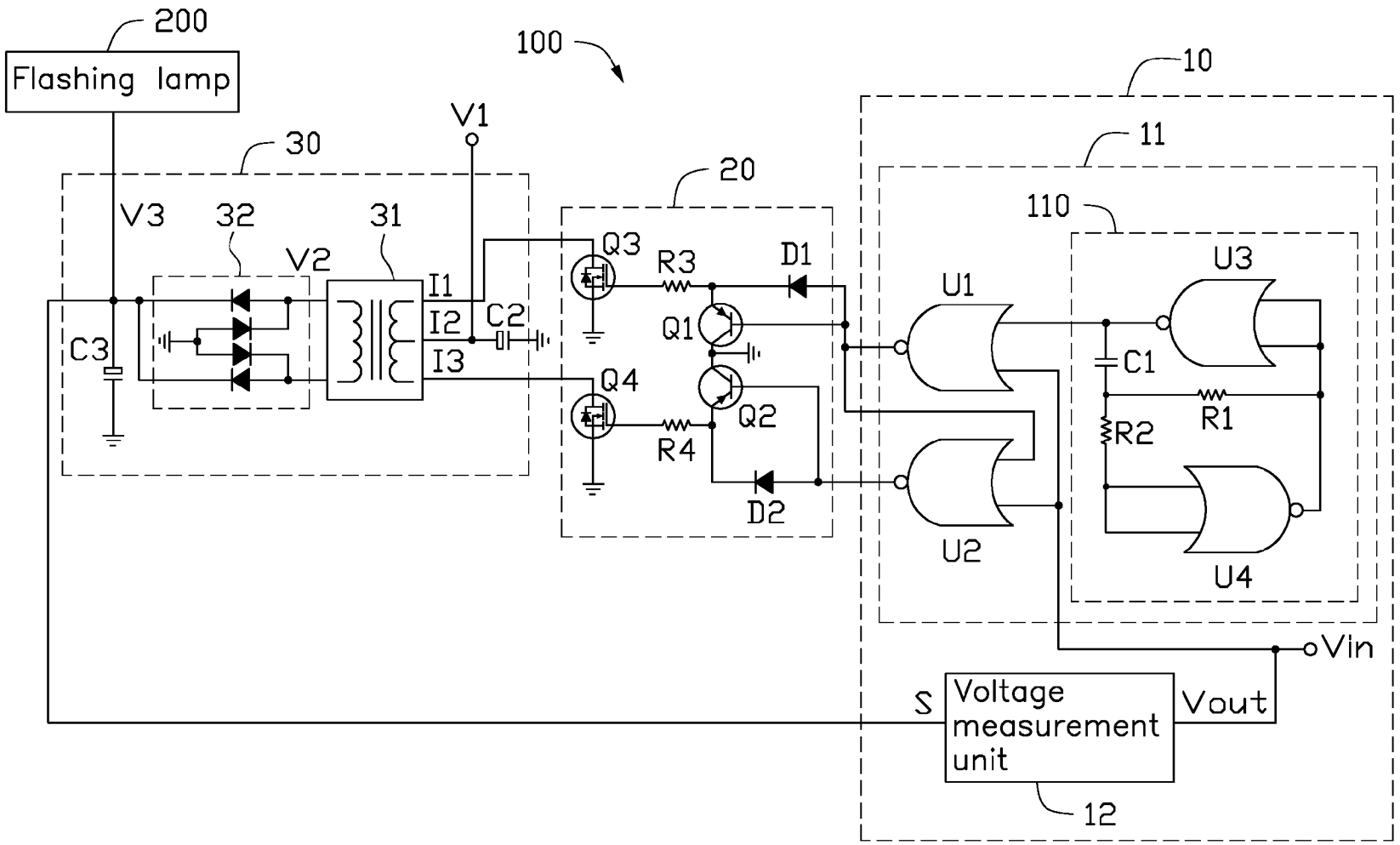
10
11
110
U3
U4
R1
C1
R2
U1
U2
Vin
Vout
Voltage measurement unit
12
S
20
D1
D2
Q1
Q2
R3
R4
Q3
Q4
100
V1
C2
I1
I2
I3
31
V2
30
32
V3
C3
200
Flashing lamp

FLASHING LAMP CONTROL CIRCUIT

FIELD

The subject matter herein generally relates to lighting.

BACKGROUND

An ordinary flashing lamp control circuit typically includes a plurality of integrated circuit components or power supply circuits to realize a boost process for a flashing lamp. Too many components or power supply circuits may reduce boost efficiency and reliability of the circuit, and increase costs.

SUMMARY OF THE INVENTION

An efficient and reliable flashing lamp control circuit is described.

A flashing lamp control circuit includes a control module and a voltage measurement unit. The control unit includes an input terminal, an oscillator, a first NOR gate, and a second NOR gate. The input terminal of the control unit is connected to the voltage measurement unit for receiving a first input signal output from the voltage measurement unit, and a first input terminal of the first NOR gate is connected to an output terminal of the oscillator. A first input terminal of the second NOR gate is connected to an output terminal of the first NOR gate. A second input terminal of the first NOR gate and a second input terminal of the second NOR gate are connected to the input terminal of the control unit, the first and second NOR gates output a first control signal and a second control signal, the second control signal having opposite potential to the first control signal.

The control circuit also includes a strobe module which includes a first input terminal and a second input terminal. The first input terminal and the second input terminal are connected to the output terminals of the first and second NOR gates respectively, and output a third control signal and a fourth control signal according to the first control signal and the second control signal.

A booster module is also included, the booster module includes an output terminal and a step-up transformer connected to the strobe module. The step-up transformer receives the third and fourth control signals and a first input voltage, and converts the first input voltage into a second voltage and outputs the second voltage at the output terminal. A measurement terminal of the voltage measurement unit is connected to the output terminal of the booster module, and when the voltage measurement unit detects that the second voltage reaches a preset voltage, the voltage measurement unit outputs a second input signal to the input terminal of the control unit, to stop the strobe module and the booster module working.

The flashing control circuit controls the first NOR gate and the second NOR gate to output the first control signal and the second opposite control signal to the strobe module through the alternating signal generated by the oscillator of the control module. The booster module thereby applies boosting, reducing the number of components and reducing the cost and power consumption of the lamp and control circuit. The operating efficiency of the circuit is also improved. Further, the reduced number of components facilitates maintenance and troubleshooting of circuit faults.

BRIEF DESCRIPTION OF THE DRAWING

The drawing is a circuit diagram of a flashing lamp control circuit of a preferred embodiment of the disclosure, the flashing lamp control circuit being connected to a flashing lamp.

Implementations of the present technology will now be described, by way of example only, with reference to the drawing.

DETAILED DESCRIPTION

As shown in the drawing, a flashing lamp control circuit 100 of the present embodiment is connected to a flashing lamp 200 to provide power to the flashing lamp 200. The flashing lamp control circuit 100 includes a control module 10, a strobe module 20, and a booster module 30. The strobe module 20 is connected to the control module 10 and is configured to work based on a control signal output from the control module 10. The booster module 30 is connected to the strobe module 20, and is configured to convert a low voltage signal to a high voltage signal based on the strobe module 20 and output the high voltage signal to the flashing lamp 200. The control module 10 is connected to the booster module 30, and a boost process is ended by measuring a certain voltage of the flashing lamp 200.

The flashing lamp control circuit 100 includes a control unit 11 and a voltage measurement circuit 12. The control unit 11 includes an input terminal Vin, an oscillator 110, a NOR gate U1, and a NOR gate U2. The input terminal Vin of the control unit 11 is connected to an output terminal Vout of the voltage measurement unit 12 to receive a first input signal or a second input signal from the voltage measurement unit 12. The oscillator 10 includes NOR gates U3, U4, resistors R1, R2, and a capacitor C1. A first input terminal of the NOR gate U3 is connected to a second input terminal of the NOR gate U3, and is also connected to an output terminal of the NOR gate U3 through the resistor R1 and the capacitor C1. A first input terminal of the NOR gate U4 is connected to a second input terminal of the NOR gate U4, and is also connected to the output terminal of the NOR gate U3 through the resistor R2 and capacitor C1. The first and the second input terminals of the NOR gate U3 are further connected to an output terminal of the NOR gate U4. The output terminal of the NOR gate U3 acts as an output terminal of the oscillator 110 and is connected to a first input terminal of the NOR gate U1. A second input terminal of the NOR gate U1 and a second input terminal of the NOR gate U2 are both connected to the input terminal Vin of the control unit 100. A first input terminal of the NOR gate U2 is connected to the output terminal of the NOR gate U1. The NOR gate U1 and the NOR gate U2 output a first control signal and a second control signal. The second control signal has a potential which is opposite to that of the first control signal and the first and second control signals are generated in accordance with an alternating signal from the oscillator 110. In the present embodiment, the oscillator 110 is a pulse width generator.

The strobe module 20 includes electronic switches Q1, Q2, Q3, Q4, diodes D1, D2, and resistors R3, R4. In the present embodiment, the electronic switches Q1, Q2 are PNP transistors, and the electronic switches Q3, Q4 are NMOS type field effect transistors (FETs). A base of the transistor Q1 is connected to the output terminal of the NOR gate U1, and a base of the transistor Q2 is connected to the output terminal of the NOR gate U2. A collector of the transistor Q2 is connected to a collector of the transistor Q1, and is grounded. An emitter of transistor Q1 is connected to the base of the transistor Q1 through the diode D1, and is connected to a gate terminal of the FET Q3 through the resistor R3. An anode of the diode D1 is connected to the base of the transistor Q1, and a cathode of the diode D1 is connected to the emitter of the transistor Q1. A collector of transistor Q2 is connected to a base of the transistor Q2 through the diode D2, and is connected to a gate terminal of the FET Q4 through the resistor R4. An anode of the diode D2 is connected to the base of the transistor Q2, and a cathode of the diode D2 is connected to the emitter of the transistor Q2. Source terminals of FETs Q3, Q4 are grounded. Drain terminals of the FETs Q3, Q4 acting as output terminals of the strobe module 20 output a third control signal and a fourth control signal, the fourth control signal being of opposite polarity to the third control signal, according to the first control signal and second control signal.

The booster module 30 includes a step-up transformer 31, a rectifier 32, and capacitors C2, C3. The step-up transformer 31 includes a primary coil and a secondary coil. The primary coil includes a first input terminal I1, a second input terminal I2, and a third input terminal I3. The first input terminal I1 is connected to the drain of the FET Q3, the third input terminal I3 is connected to the drain of the FET Q4, and the second input terminal I2 receives a first input voltage V1. The first input voltage V1 is a voltage from a battery. One terminal of the capacitor C2 is connected to the second input terminal I2, and the other terminal of the capacitor C2 is grounded. The first input terminal I1 and the second input terminal I2 receive the third control signal and the fourth control signal from the strobe module 20. The third and fourth control signals control coil between the first input terminal I1 and the second input terminal I2 and coil between the second input terminal I2 and the third terminal I3 to work alternately to induce alternating current.

The rectifier 32 is a bridge rectifier composed of four diodes 32. The rectifier 32 receives a second voltage V2 output from the step-up transformer 31, and rectifies the second voltage V2 to output a third voltage V3. An output terminal of the rectifier 32 is connected to the flashing lamp 200. One terminal of the capacitor C3 is grounded, and the other terminal of the capacitor C3 is connected to the flashing lamp 200. A measuring terminal S of the voltage measurement unit 12 is connected to an input terminal of the flashing lamp 200, and is configured to measure a voltage at the input terminal of the flashing lamp 200.

The working principle of the control circuit is as follows:

When the flash control circuit 100 charges the flashing lamp 200, the output terminal Vout of the voltage measurement unit 12 outputs a low level signal to the input terminal Vin of the control unit, and the oscillator 110 outputs a square wave signal. When the square wave signal received by the first input terminal of the NOR gate U1 is low level, the NOR gate U1 outputs a high level control signal, and the NOR gate U2 outputs a low level control signal. The transistor Q1 is turned off, the transistor Q2 is turned on, the FET Q3 is turned on, the FET Q4 is turned off, and the coil between the first input terminal I1 and the second input terminal I2 of the primary coil of the step-up transformer 31 is energized. When the square wave signal received by the first input terminal of the NOR gate U1 is high level, the NOR gate U1 outputs a low level control signal, and the NOR gate U2 outputs a high level control signal. The transistor Q1 is turned on, the transistor Q2 is turned off, the FET Q3 is turned off, the FET Q4 is turned on, and the coil between the second input terminal 12 and the third input terminal I3 of the primary coil of the step-up transformer 31 is energized. Thus, the primary coil of the step-up transformer 31 generates alternating current. The step-up transformer 31 works accordingly, and the secondary coil of the step-up transformer 31 induces and outputs the second voltage V2 according to the first input voltage V1 received by the primary coil. The rectifier 32 receives and rectifies the second voltage V2 of the step-up transformer 31 and outputs the rectified voltage to the capacitor C3 to store energy, and then charges the flashing lamp 200. In the present embodiment, the transistors Q1, Q2 are configured to turn off the FETs Q3, Q4 quickly and reliably.

When the voltage measurement unit 12 measures that a third voltage V3 at the input terminal of the flashing lamp 200 has reached a preset voltage, such as 330V, the output terminal Vout of the voltage measurement unit 12 outputs a high level signal to the input terminal of the control unit. The first and second input terminals of the NOR gates U1, U2 receive the high-level signal, and output a low level control signal. The transistors Q1, Q2 are turned on, the FETs Q3, Q4 are turned off, the primary coil of the step-up transformer 31 only receives the first input voltage V1 and cannot produce the alternating current. The step-up transformer 31 stops the boosting operation. Thus, when the third voltage V3 of the flashing lamp 200 reaches 330V, the power supply circuit stops providing power to the flashing lamp 200.

The oscillator 110 of the control module 10 generates a square-wave signal to control the NOR gates U1, U2 to output the first control signal and the second opposite control signal. The first and second control signals to the strobe module control the booster module to accomplish boosting operation, thus reducing the conventional number of components.

Those skilled in the art will recognize that the above described embodiments are only intended to illustrate the invention and are not intended to limit the invention, and numerous possible modifications and variations within the spirit of the invention will fall within the scope of the invention.

What is claimed is:

1. A flashing lamp control circuit, comprising:

a control module, comprising a control unit and a voltage measurement unit, the control unit comprising an input terminal, an oscillator, a first NOR gate, and a second NOR gate, the input terminal of the control unit connected to the voltage measurement unit for receiving a first input signal output from the voltage measurement unit, a first input terminal of the first NOR gate connected to an output terminal of the oscillator, a first input terminal of the second NOR gate connected to an output terminal of the first NOR gate, a second input terminal of the first NOR gate and a second input terminal of the second NOR gate connected to the input terminal of the control unit, the first and second NOR gates outputting a first control signal and a second control signal, the second control signal having opposite potential to the first control signal;

a strobe module, comprising a first input terminal and a second input terminal, the first input terminal and the second input terminal connected to the output terminals of the first and second NOR gates respectively, and output a third control signal and a fourth control signal according to the first control signal and the second control signal; and a booster module, comprising an output terminal and a step-up transformer connected to the strobe module, the step-up transformer receiving the third and fourth control signals and a first input voltage, and converting the first input voltage into a second voltage and output the second voltage at the output terminal, a measurement terminal of the voltage measurement unit connected to the output terminal of the booster module, and when the voltage measurement unit detects that the second voltage reaches a preset voltage, the voltage measurement unit outputs a second input signal to the input terminal of the control unit, to stop the strobe module and the booster module working.

2. The flashing lamp control circuit according to claim 1, wherein the oscillator comprises a third NOR gate, a fourth NOR gate, a first resistor, a second resistor, and a first capacitor, a first input terminal of the third NOR gate is connected to a second input terminal of the third NOR gate, and is connected to an output terminal of the third NOR gate through the first resistor and the first capacitor, the output terminal of the third NOR gate is connected to the first input terminal of the first NOR gate; a first input terminal of the fourth NOR gate is connected to a second input terminal of the fourth NOR gate, and is connected to the output terminal of the third NOR gate through the second resistor and the first capacitor, and the first and second input terminals of the third NOR gate are further connected to an output terminal of the fourth NOR gate.

3. The flashing lamp control circuit according to claim 2, wherein the strobe module comprising a first electronic switch, a second electronic switch, a third electronic switch, and a fourth electronic switch, first terminals of the first electronic switch and the second electronic switch are connected to the output terminals of the first NOR gate and the second NOR gate respectively, second terminals of the first electronic switch and the second electronic switch are grounded, a third terminal of the first electronic switch is connected to the first terminal of the first electronic switch and the first terminal of the third electronic switch, a third terminal of the second electronic switch is connected to a first terminal of the second electronic switch and a first terminal of the fourth electronic switch, second terminals of the third and fourth electronic switches are connected to the step-up transformer, and third terminals of the third and fourth electronic switches are grounded.

4. The flashing lamp control circuit according to claim 3, wherein the strobe module further includes a first diode and a second diode, an anode of the first diode is connected to the first terminal of the first electronic switch, a cathode of the first diode is connected to the third terminal of the first electronic switch, an anode of the second diode is connected to the first terminal of the second electronic switch, and a cathode of the second diode is connected to the third terminal of the second electronic switch.

5. The flashing lamp control circuit according to claim 4, wherein the strobe module further comprises a third resistor and a fourth resistor, one terminal of the third resistor is connected to the third terminal of the first electronic switch, the other terminal of the third resistor is connected to the first terminal of the third electronic switch, one terminal of the fourth resistor is connected to the third terminal of the second electronic switch, and the other terminal of the fourth resistor is connected to the first terminal of the fourth electronic switch.

6. The flashing lamp control circuit according to claim 5, wherein the first and second electronic switches are PNP transistors, and the first terminals, second terminals, and third terminals of the first and second electronic switches are corresponding to the base, collector and emitter of the PNP transistors.

7. The flashing lamp control circuit according to claim 6, wherein third and fourth electronic switches are NMOS FETs, the first terminals, second terminals and third terminals of the third and the fourth electronic switches are corresponding to the gate terminal, drain terminal and source terminal of the NMOS FETs.

8. The flashing lamp control circuit according to claim 3, wherein the step-up transformer comprises a first input terminal, a second input terminal, and a third input terminal, the first input terminal is connected to the second terminal of the third electronic switch, the second input terminal receives the first input voltage, and the third input terminal is connected to the second input terminal of the fourth electronic switch.

9. The flashing lamp control circuit according to claim 8, wherein the booster module further comprises a rectifier and a second capacitor, a terminal of the second capacitor is connected to the second input terminal of the step-up transformer, the other terminal of the second capacitor is grounded, and the rectifier is connected to the step-up transformer to rectify the second voltage output from the step-up transformer and output the rectified voltage.

10. The flashing lamp control circuit according to claim 9, the booster module further comprises a third capacitor, one terminal of the third capacitor is connected to the output terminal of the rectifier, and the other terminal of the third capacitor is grounded.

11. The flashing lamp control circuit according to claim 7, wherein the step-up transformer comprises a first input terminal, a second input terminal, and a third input terminal, the first input terminal is connected to the second terminal of the third electronic switch, the second input terminal receives the first input voltage, and the third input terminal is connected to the second input terminal of the fourth electronic switch.

* * * * *